US006244556B1

(12) United States Patent
Carrillo et al.

(10) Patent No.: US 6,244,556 B1
(45) Date of Patent: Jun. 12, 2001

(54) BOW HOLDER

(76) Inventors: John P. Carrillo, 3314 Edgecliff Dr., Garland, TX (US) 75043; Jason Mims, 117 Carmen, Red Oak, TX (US) 75154

( * ) Notice: Subject to any disclaimer, the term of this patent is extended or adjusted under 35 U.S.C. 154(b) by 0 days.

(21) Appl. No.: 09/442,449

(22) Filed: Nov. 18, 1999

(51) Int. Cl.[7] ..... F16M 13/00
(52) U.S. Cl. ..... 248/519; 182/187
(58) Field of Search ..... 248/519; 182/187; 124/86, 88, 23.1

(56) References Cited

U.S. PATENT DOCUMENTS

| | | | | |
|---|---|---|---|---|
| D. 316,780 | | 5/1991 | Chilcutt et al. . | |
| D. 355,694 | * | 2/1995 | Stafford, Jr. | D22/107 |
| D. 371,416 | * | 7/1996 | Bliss | D22/107 |
| 2,899,155 | * | 8/1959 | Rogers | 248/514 |
| 3,011,587 | * | 12/1961 | Mallog | 182/150 |
| 4,331,311 | | 5/1982 | Russell . | |
| 4,474,296 | | 10/1984 | Hartman . | |
| 4,729,363 | | 3/1988 | Skyba . | |
| 4,936,415 | | 6/1990 | Williams . | |
| 5,044,590 | * | 9/1991 | Carafice | 248/309.1 |
| 5,048,504 | | 9/1991 | Ballard . | |
| 5,240,211 | * | 8/1993 | Anderson | 248/125.3 |
| 5,344,110 | * | 9/1994 | Scarpa | 248/229.15 |
| 5,377,657 | | 1/1995 | Foster et al. . | |
| 5,465,933 | | 11/1995 | Todd . | |
| 5,626,322 | * | 5/1997 | Braun | 248/282.1 |
| 5,727,760 | * | 3/1998 | Wytovak et al. | 248/217.3 |
| 5,806,508 | * | 9/1998 | Stempien et al. | 124/86 |
| 6,012,439 | * | 1/2000 | Woodruff | 124/1 |
| 6,021,768 | * | 2/2000 | Pomaville | 124/1 |
| 6,059,240 | * | 5/2000 | Gorsuch | 248/219.4 |

* cited by examiner

*Primary Examiner*—Anita M. King
*Assistant Examiner*—N. Morrison
(74) *Attorney, Agent, or Firm*—Stephen R. Greiner

(57) ABSTRACT

A bow holder including a base having a mounting plate and a first tubular sleeve affixed thereto. A carrier extends from the base and has a rod selectively slidably positioned within the first tubular sleeve. The carrier also has a first leg extending downwardly from the rod. A platform, having a slot for receiving the bottom of a bow, is cantilevered on the carrier. The platform has a second tubular sleeve at its rear end selectively slidably positioned upon the first leg and a third tubular sleeve at its front end. A prop extends upwardly from the front end of the platform. The prop has a second leg selectively slidably positioned within the third tubular sleeve and a U-shaped member affixed atop the second leg for engaging the lower limb of a bow and supporting the bow in an upright orientation.

3 Claims, 1 Drawing Sheet

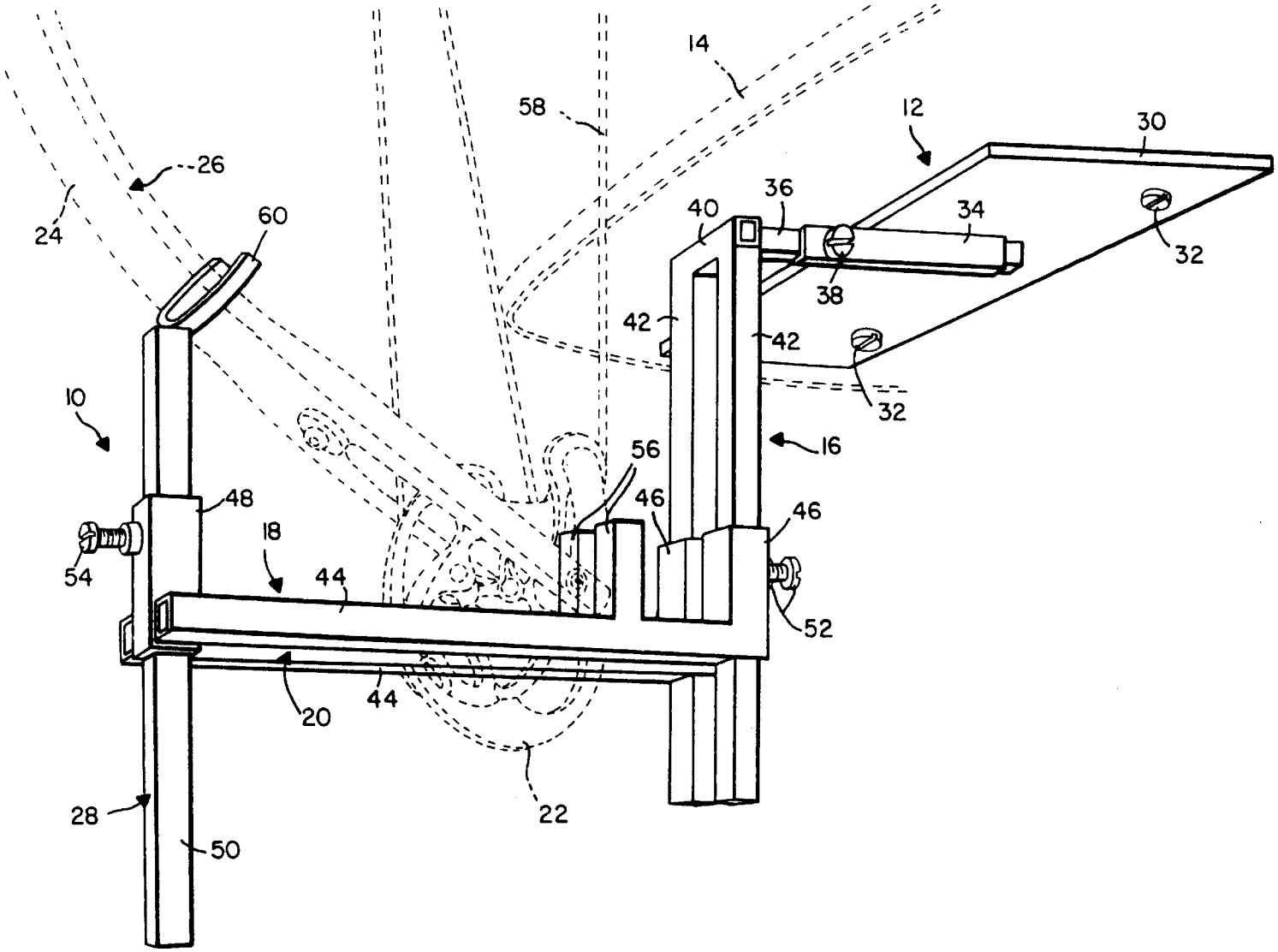
10
12
14
16
18
20
22
24
26
28
30
32
32
34
36
38
40
42
42
44
44
46
46
48
50
52
54
56
58
60

BOW HOLDER

FIELD OF THE INVENTION

The invention relates generally to article supports and to apparatus for supporting bows in upright positions.

BACKGROUND OF THE INVENTION

Many bow hunters use tree stands to widen their field of view while pursuing game. Many such stands are small in size and have seats for supporting a single hunter for long periods of time. Unfortunately, a lack of storage space greatly reduces the amount of gear which can be positioned upon a stand with a hunter. Even a bow must sometimes be secured away from the stand.

Because it is uncomfortable to hold a bow in a ready-to-use position for substantial periods of time, many hunters hang their bows from nearby tree limbs or other makeshift supports. Of course, reaching for a bow can startle game and cause such to flee. Careless handling of the bow can permanently damage it too.

To avoid these problems, products have been proposed for securing bows to tree stands. These products have generally been cumbersome to use, requiring large movements of a hunter's arms and torso to gain access to the bow and bring it to a discharge position. A need, therefore, exists for a bow holder which may be secured to a stand for holding a bow in a position where it may be readily used by a hunter.

SUMMARY OF THE INVENTION

In light of the problems associated with the known products for securing bows to tree stands and the like, it is a principal object of the invention to provide an apparatus which is preferably secured to the bottom of a hunter's seat for holding a bow in an upright, ready-to-use position in front of a hunter's torso. If the seat is of swivel-type, the bow will turn with the hunter as he swivels the chair toward a target during use.

It is another object of the invention to provide bow holder of the type described which may be readily adjusted to accommodate bows of different types and users of various size.

It is a further object of the invention to provide a bow holder which can be used without resort to special tools or extensive training.

It is an object of the invention to provide improved elements and arrangements thereof in a bow holder for the purposes described which is lightweight in construction, inexpensive to manufacture, and dependable in use.

Briefly, the bow holder in accordance with this invention achieves the intended objects by featuring a base having a mounting plate for attachment to a hunter's seat. A carrier extends forwardly and downwardly from the base. A platform, having a slot for receiving the bottom of a bow, is cantilevered on the carrier. A prop extends upwardly from the front end of the platform. The prop has a U-shaped member at its top for engaging the lower limb of a bow and supporting the bow in an upright orientation. The relative positions of the base, carrier, platform and prop may be adjusted by means of set screws.

The foregoing and other objects, features and advantages of the present invention will become readily apparent upon further review of the following detailed description of the preferred embodiment as illustrated in the accompanying drawings.

BRIEF DESCRIPTION OF THE DRAWING

The present invention may be more readily described with reference to the accompanying drawing which is a perspective view of a bow holder in accordance with the present invention shown mounted on a hunter's seat.

DETAILED DESCRIPTION OF THE PREFERRED EMBODIMENT

Referring now to the drawing, a bow holder in accordance with the present invention is shown at 10. Holder 10 includes a base 12 affixed to the bottom of a hunter's seat 14 and a carrier 16 extending forwardly and downwardly from base 12. Cantilevered on carrier 16 is a platform 18 with a slot 20 for receiving the eccentric cam 22 on the lower limb 24 of a compound bow 26. A prop 28 extends upwardly from the front of platform 18 for engaging lower limb 24 above cam 22 and supporting bow 26 in an upright orientation.

Base 12 comprises a mounting plate 30 having apertures (not shown) through which threaded fasteners 32 are extended to attach base 12 to seat 14. A tubular sleeve 34 is affixed to the bottom of plate 30 so as to slidably receive support rod 36 of carrier 16. A set screw 38 is penetrates one side of sleeve 34 for selectively locking rod 36 at the desired position within sleeve 34.

Carrier 16 includes a crosspiece 40 affixed to the front of rod 36 and a pair of legs 42 extending downwardly from the opposed ends of crosspiece 40. As shown, legs 42 are spaced-apart and parallel to one another.

Platform 18 has a pair of parallel arms 44 spaced so as to form slot 20 therebetween. Affixed to the rear ends of arms 44 are a pair of tubular sleeves 46 adapted to slidably receive legs 42 of carrier 16. Affixed between the front ends of arms 44, however, is a tubular sleeve 48 for slidably receiving the upright leg 50 of prop 28. Set screws 52 and 54 respectively penetrate sleeves 46 and 48 for engaging and selectively locking legs 42 and 50 at desired positions within sleeves 46 and 48. A pair of fingers 56 are affixed to arms 44 between sleeves 46 and 48 which serve as stops or abutments for the bottom of lower limb 24 of bow 26. Fingers 56 prevent cam 22 or the drawstring 58 of bow 26 from wearing on carrier 16 during use of holder 10.

Affixed atop leg 50 of prop 28 is a U-shaped member 60. Member 60 is sized to snugly receive lower limb 24 of bow 26 therein and is rearwardly canted to engage limb 24 at right angles.

Use of bow holder 10 is straightforward. First, base 12 is attached to seat 14 by means of threaded fasteners 32. Next, with a user positioned on seat 14, rod 36 of carrier 16 is extended into sleeve 34 and secured there by tightening set screw 38. Then, platform 18 is similarly joined to carrier 16 and prop 28 is joined to platform 18 by means of set screws 52 and 54. Finally, bow 26 is positioned on holder 10 with lower limb 24 engaged with fingers 56 and U-shaped member 60. By selectively untightening set screws 38, 52 and 54 and manually adjusting the relative positions of carrier 16, platform 18 and prop 28, a user may locate bow 26 in a comfortable, ready-to-use position in front of his torso.

Disassembly of holder 10 is equally simple. A user need only reverse the steps outlined above. The process requires a few seconds, at most, to accomplish. The individual components of holder 10 may be stored together in the trunk of a car or other out of the way location for later use.

While the invention has been described with a high degree of particularity, it will be appreciated by those skilled in the art that modifications may be made thereto. Therefore, it is to be understood that the present invention is not limited to the sole embodiment described above, but encompasses any and all embodiments within the scope of the following claims.

We claim:

1. A bow holder, comprising:

a base having a mounting plate and a first tubular sleeve affixed to said mounting plate, said base also having a first set screw penetrating said first tubular sleeve;

a carrier extending from said base, said carrier having a rod selectively slidably positioned within said first tubular sleeve and being adapted for snug engagement with said first set screw, said carrier also having a first leg extending downwardly from said rod;

a platform, having a slot for receiving the bottom of a bow, cantilevered on said carrier, said platform having front and rear ends and a second tubular sleeve at said rear end and a third tubular sleeve at said front end, said platform also having a second set screw penetrating said second tubular sleeve and a third set screw penetrating said third tubular sleeve, said second tubular sleeve being selectively slidably positioned upon said first leg, and said second set screw being adapted for snug engagement with said first leg; and, a prop extending upwardly from said front end of said platform, said prop having a second leg selectively slidably positioned within said third tubular sleeve and being adapted for snug engagement with said third set screw, said prop also having a U-shaped member affixed atop said second leg for engaging a lower limb of the bow and supporting the bow in an upright orientation.

2. A bow holder, comprising:

a base having an apertured mounting plate for fastening to the bottom of a seat and a first tubular sleeve affixed to said mounting plate, said base also having a first set screw penetrating said first tubular sleeve;

a carrier extending from said base, said carrier having a rod selectively slidably positioned within said first tubular sleeve and being adapted for snug engagement with said first set screw, said carrier also having a pair of first legs extending downwardly from said rod;

a platform having a slot for receiving the bottom of a bow, said platform having front and rear ends and a pair of second tubular sleeves at said rear end and a third tubular sleeve at said front end, said platform also having a pair of second set screws respectively penetrating said second tubular sleeves and a third set screw penetrating said third tubular sleeve, said second tubular sleeves being slidably positioned upon said first legs, and said second set screws being respectively adapted for snug engagement with said first legs; and, a prop extending upwardly from said front end of said platform , said prop having a second leg selectively slidably positioned within said third tubular sleeve and being adapted for snug engagement with said third set screw, said prop also having a U-shaped member affixed atop said second leg for engaging a lower limb of the bow and supporting the bow in an upright orientation.

3. A bow holder, comprising:

a base having an apertured mounting plate for fastening to the bottom of a seat and a first tubular sleeve affixed to said mounting plate, said base also having a first set screw penetrating said first tubular sleeve;

a carrier extending from said base, said carrier having a rod selectively slidably positioned within said first tubular sleeve and being adapted for snug engagement with said first set screw, said carrier also having a pair of first legs extending downwardly from said rod;

a platform having a pair of parallel arms defining a slot therebetween for receiving a cam at the bottom of a bow, said arms having front and rear ends and a pair of second tubular sleeves at said rear end thereof and a third tubular sleeve at said front end thereof, said platform also having a pair of second set screws respectively penetrating said second tubular sleeves and a third set screw penetrating said third tubular sleeve, said second tubular sleeves being slidably positioned upon said first legs, and said second set screws being respectively adapted for snug engagement with said first legs; and, a prop extending upwardly from said front end of said platform, said prop having a second leg selectively slidably positioned within said third tubular sleeve and being adapted for snug engagement with said third set screw, said prop also having a U-shaped member affixed atop said second leg for engaging a lower limb of the bow and supporting the bow in an upright orientation.

* * * * *